US005080375A

United States Patent [19]

Moosavi

[11] Patent Number: 5,080,375

[45] Date of Patent: Jan. 14, 1992

[54] ADJUSTABLE SOCCER GOAL

[76] Inventor: Kassra Moosavi, 3377 Quincy, Ogden, Utah 84403

[21] Appl. No.: 611,532

[22] Filed: Nov. 13, 1990

[51] Int. Cl.[5] ..... A63B 63/00

[52] U.S. Cl. ..... 273/400; 273/411

[58] Field of Search ..... 273/398, 400, 411

[56] References Cited

U.S. PATENT DOCUMENTS

| | | | |
|---|---|---|---|
| 4,083,561 | 4/1978 | Daffer, Jr. | 273/411 X |
| 4,127,272 | 11/1978 | Pennell | 273/398 |
| 4,258,923 | 3/1981 | Senoh | 273/398 |
| 4,407,507 | 10/1983 | Caruso et al. | 273/400 |

FOREIGN PATENT DOCUMENTS

| | | | |
|---|---|---|---|
| 2551982 | 3/1985 | France | 273/400 |
| 945760 | 1/1964 | United Kingdom | 273/400 |

*Primary Examiner*—William H. Grieb
*Attorney, Agent, or Firm*—A. Ray Osburn

[57] ABSTRACT

A soccer goal assembly adjustable in size and shape to accommodate playing areas of limited to full sizes, indoors or outdoors, full or partial teams, and children or adult players. The goal assembly has a framework covered by a ball stopping net. Individual frame members can be selected or assembled in selective lengths for the desired goal sizes.

12 Claims, 3 Drawing Sheets

ADJUSTABLE SOCCER GOAL

BACKGROUND OF THE INVENTION

1. Field

The field of the invention is soccer goal structures and more particularly such structures which may be adjusted to various sizes, and collapsed or disassembled for convenient storage and transport.

2. State of the Art

Regulation soccer goals are typically constructed of heavy steel pipe anchored into the ground at each end of a playing field, providing a stable permanent structure upon which to install netting to receive the ball. Playing fields with such goals are scarce, limiting practice and effectively hampering the growth of the sport of soccer. In contrast, easily improvised playing areas for basketball, football and baseball encourage practice of these sports by both juveniles and adults. Basketball goals of selective height are quite common, so that even quite small children are not dissuaded from playing. However, available soccer goal designs are not suitable for use by both children and adults, or by smaller than regulation team sizes, or even for use on normally available, limited size, playing areas.

A number of portable soccer goals have been developed. U.S. Pat. No. 4,127,272 discloses a goal which may be folded after partial disassembly. The goal disclosed however is of regulation size, and would be incongruous installed in an available backyard or a like area. It would in fact be quite impossible to miss such a goal in such a small practice area. The soccer practice net of U.S. Pat. No. 4,083,561 can also be disassembled for portability, but again does not provide the size selectivity needed for practice areas of normally limited sizes. Nor do these goals provide the small sizes needed for use by small children.

Clearly, a need exists for a soccer goal which can be readily disassembled for transport and storage, and which also has a large range of selective sizes and shapes.

BRIEF SUMMARY OF THE INVENTION

With the foregoing in mind, the present invention eliminates or substantially alleviates the shortcomings and disadvantages of prior art soccer goals, by providing such a goal that may be readily disassembled for transport and storage, which may be adjusted in size, and which may be installed for both indoor and outdoor playing areas. The preferred embodiment of the invention comprises a net-supporting frame, preferably made of tubular material, which can be easily and quickly assembled and disassembled. The lengths of the members making up the frame can be selected to provide various frame sizes and shapes over a wide range. A soccer ball backstop of netting covers back and side portions of the frame, and is adapted for use with the frame assembled into the wide range of selective sizes.

Tubular members are utilized to define a pair of right triangular side portions of the frame. The side portions are disposed in spaced apart, generally parallel planes, each with a front member disposed in the vertical direction and a lowermost member extending horizontally rearward. A pair of horizontal cross members connect the upper front apexes and the lower rear apexes of the triangular side frame portions. A single piece molded connector at each of the tube junctures provides friction-fit socket for each tube end. To disassemble the frame, the individual frame members are manually removed from the sockets. Four molded connectors are needed at the bottom of the frame and two at each front apex of the triangular frame side portions. The four bottom connectors each incorporate a ground-contacting foot, preferably comprising a horizontal flange member with spaced apart vertical bores for anchoring spikes or the like.

Each individual frame member preferably comprises a pair of larger tubular end sections, a smaller center section telescoping into each larger end section, and means securing the three sections together in selective lengths as required by selected goal sizes and shapes.

Preferably, the netting is secured to the frame by threading appropriate frame members through its edge intersticies. The netting is preferably of a single piece large enough to cover the largest goal provided by fully extended frame members. The netting may then be accordioned along shorter frame members to accommodate smaller goals.

It is therefore the principal object of the invention to provide a soccer goal which may be easily dismantled for storage, subsequently assembled into goals over a wide range of selected sizes and shapes and installed upon selected indoor or outdoor playing surfaces.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
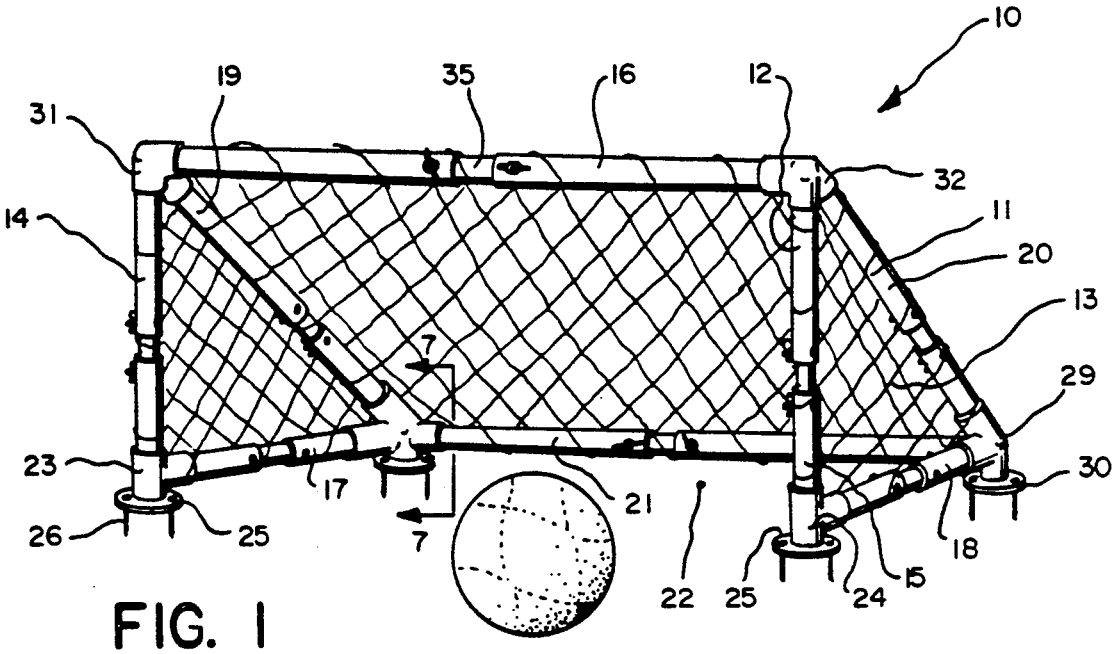
FIG. 1 is a front right perspective view of an adjustable soccer goal assembly in accordance with the invention, drawn to a reduced scale, FIG. 2 a front elevation view of the frame of the soccer goal assembly of FIG. 1, drawn to the same scale, and indicating also in dashed lines a soccer goal frame of a selected larger size, FIG. 3 a right side elevation view of the frame of the soccer goal assembly of FIG. 1, drawn to the same scale, and indicating also, in dashed lines, a larger selective size of the frame, FIG. 4 a fragmental vertical sectional view of the goal frame of FIG. 2, showing one of the front uppermost three-way frame member joining units, partially cut away to show a frame member receiving socket, drawn to a larger scale than that of FIG. 2, FIG. 5 an elevation view of a fragment of the goal frame of FIG. 2, showing the two-way frame member joint at the lower front of the assembled frame, drawn to the scale of FIG. 4, FIG. 6 a cross sectional of fragments of a typical adjustable length frame member in accordance with the invention, showing fragments of the telescoping portions thereof, drawn to the approximate scale of FIG. 4, FIG. 7 a vertical sectional view of a fragment of the frame of the assembled goal of FIG. 1, showing one of the lowermost rear three-way frame connecting joints, drawn to the scale of FIG. 4, FIG. 8 a fragment of a typical frame member and netting upended thereto, drawn to the approximate scale of FIG. 4, FIG. 9 a side elevation view of a fragment of the frame of FIG. 1, however employing an alternative selective frame member, drawn to the scale of FIG. 3, FIG. 10 a cross sectional view of a fragment of one of the frame members of the goal assembly of FIG. 1, showing the employment of a detent to secure the member in select length, drawn to the approximate scale of FIG. 3, and FIG. 11 an elevation view of a fragment of the frame of the goal assembly of FIG. 1, showing another alternative design for the selective length frame members, drawn to the scale of FIG. 3.
Figure 2:
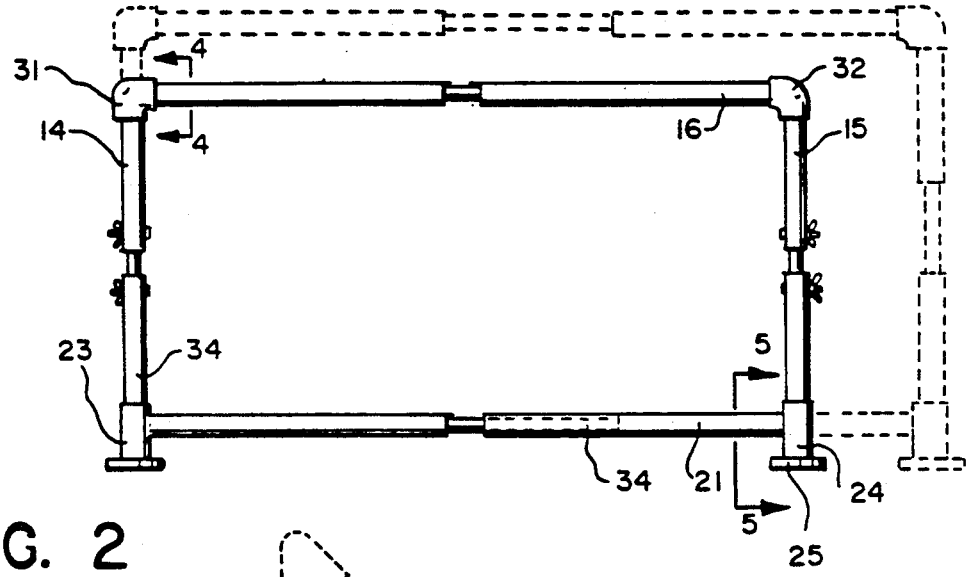
Figure 3:
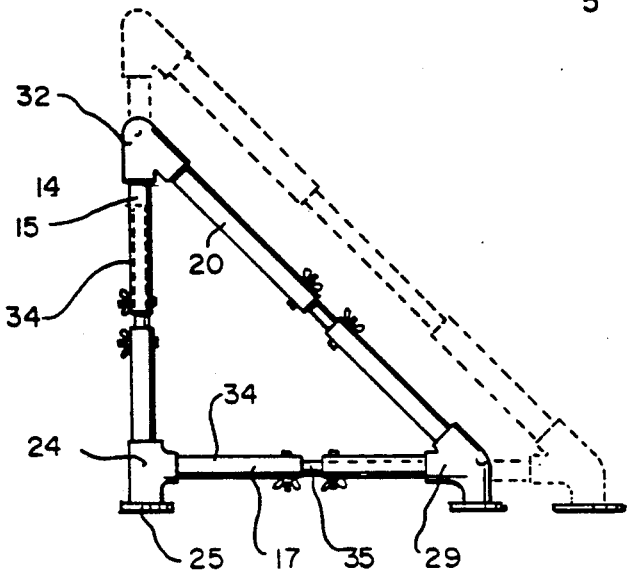

An assembled portable adjustable soccer goal 10 in accordance with the invention is shown in FIG. 1 installed upon a plot of ground utilized as a playing area. Goal 10 comprises frame 11 with a vertical ball-receiving front opening 12 and a ball stopping net 13. Front opening 12 is defined by vertical end members 14 and 15, joined at their top ends by a front upper frame member 16. Horizontal side members 17 and 18, inclined side members 19 and 20, and a rear horizontal member 21, covered by net 13, form a ball-collecting pocket 22. FIGS. 2 and 3 show the assembled frame 11 from the front and right side respectively.

Each of the individual frame members is an assembly of plastic tubing. As later described, the lengths of the assembled members may be selected to provide a range of shapes and sizes for goal 10. A pair of two-way connectors 23 and 24 are molded to secure the bottom ends of vertical members 14 and 15, and also the front ends of horizontal side members 17 and 18. Integrally molded circular bearing feet 25 support goal 10 upon the ground. Ground-engaging spikes 26 through vertical bores 27 anchor goal 10 to the ground.

Rear three-way connectors 28 and 29 accept the back ends of members 17 and 18, the lower ends of inclined members 19 and 20 and the ends of rear horizontal member 21. The rear connectors each also have an integral ground-contacting foot 30 with vertical bores 27 for anchoring.

Three-way top corner connectors 31 and 32 receive the upper ends of vertical front members 14 and 15, the ends of top cross member 16 and the upper ends of inclined members 19 and 20.

Figure 4:
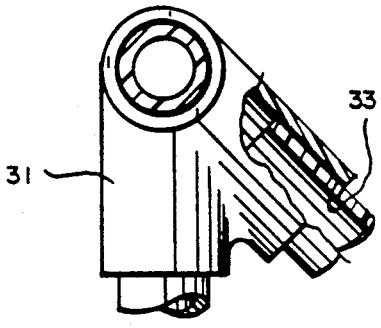
Figure 5:
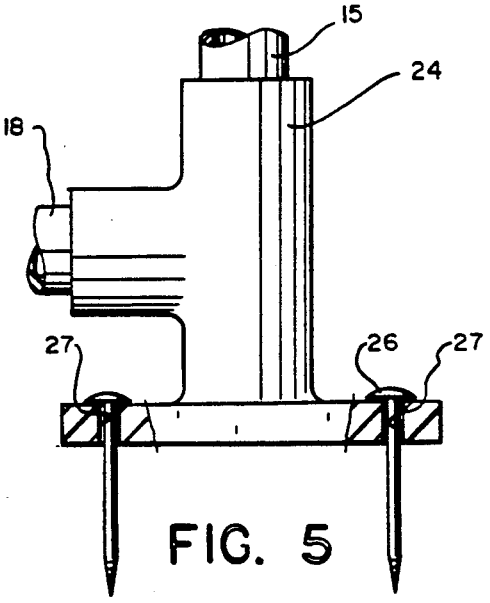

The connectors each provide properly positioned and sized sockets 33 to frictionally engage the tubing ends firmly but removably. (FIG. 4)

Figure 6:
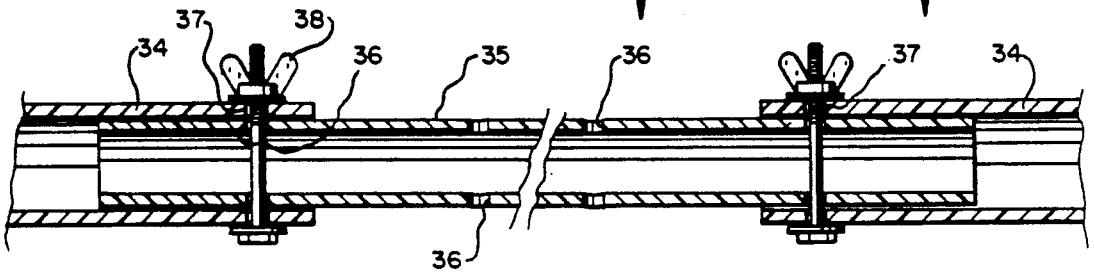
Figure 7:
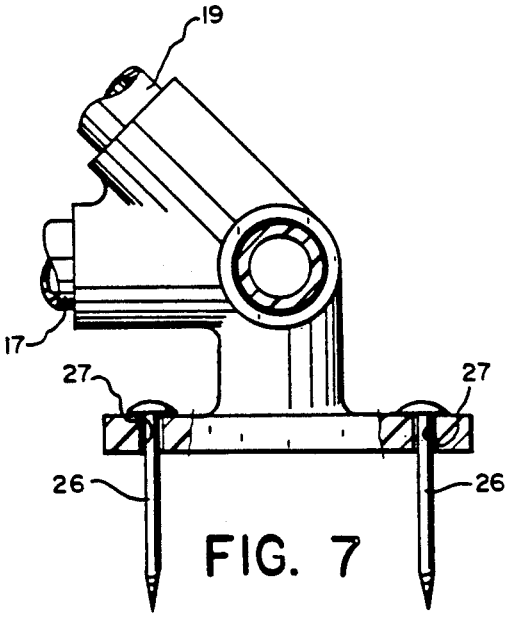

In this illustrated embodiment, each frame member is constructed of a pair of plastic end tubes 34, which are engaged by respective sockets 33 in the various connectors. An interior tube 35 is sized to loosely telescope within end tubes 34. (FIG. 6) Through bores 36 are provided at spaced intervals along telescoping tube 35, which may be aligned with end bores 37 on outside tubes 34. Telescoping tube 35 and end tubes 34 are secured together, as by thumb screws 38, to provide frame member assemblies of selected lengths.

The size and shape of soccer goal 10 may be selected by selection of the lengths of the individual frame members. The width of goal 10 is selected by simultaneous adjustment of the lengths of front and rear horizontal members 16 and 21. Adjustment of goal height requires adjustment of the lengths of vertical members 14 and 15, inclined members 19 and 20, and horizontal side members 17 and 18. In this manner, goal 10 is adapted to sizes and shapes compatible with available playing field size, and also with both juvenile and adult player sizes. See FIGS. 2 and 3, which indicate in dashed lines the frame of the goal of FIG. 1 expanded both in length and height.

Figure 8:
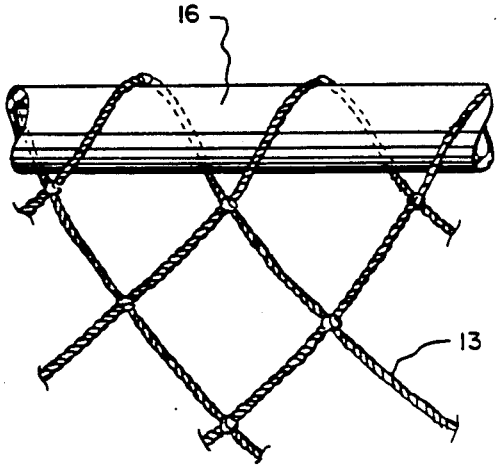

Preferably, net 13 is installed upon frame 11 by threading the frame members through appropriately located openings in net 13. (FIG. 8) Preferably, the net is provided in sufficient size and in appropriate shape to cover the top and both ends of the frame 11 fully extended in both height and width. To accommodate smaller goal sizes, net 13 is accordioned as necessary upon the frame members.

Figure 9:
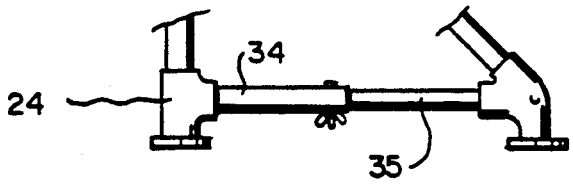
Figure 10:
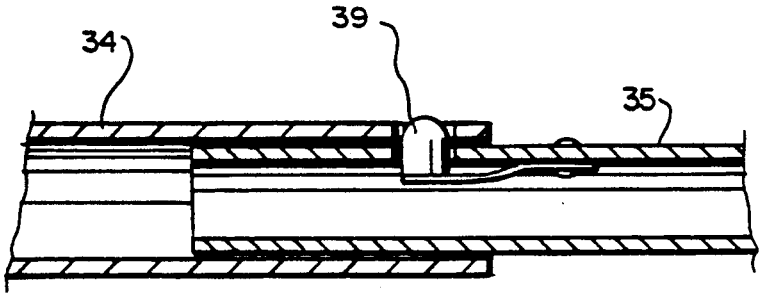
Figure 11:
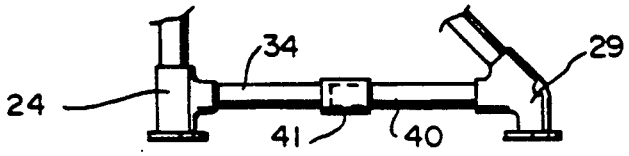

The embodiment of adjustable soccer goal 10 illustrated and described herein is based upon the use of plastic connectors and frame members. However, other materials may be used without departing from the spirit of the invention. For example, parts of the goal, or the entire goal structure, with the possible exception of the net, could be constructed of such metals as aluminum or steel. The specific method of adjusting the lengths of the individual frame members could also be changed. The members are illustrated and described as comprising two end sections with a telescoping center section secured by bolts at selected points. However, the bolts could be replaced with other fasteners, and, the frame members could involve only two pieces. In this event, the smaller telescoping member 35 could be provided with an appropriately sized socket in one of the corner connectors, eliminating one of the end tubes 34. (FIG. 9) Further, instead of the illustrated thumb screw assemblies, spring-loaded detents 39 could be used to secure the telescoping parts in selective position with respect to each other. (FIG. 10) Another way to provide goal size selectivity involves providing a set of frame length extending members 40, one for each member. (FIG. 11) With this approach, it is advantageous to provide a socket 41 to facilitate assembly of goal 10.

The invention may be embodied in still other specific forms without departing from the spirit or essential characteristics thereof. The present embodiments are, therefore to be considered as illustrative and not restrictive, the scope of the invention being indicated by the appended claims rather than by the foregoing description, and all changes that come within the meaning and range of equivalency of the claims are, therefore, intendedto be embraced therein.

What is claimed and desired to be secured by United States Letters Patent is:

1. A ball goal assembly comprising:

a frame comprising elongate members and adapted to rest generally upright upon the ground, the members defining an upright rectangular front opening and a rearwardly extending portion affixed thereto;

net means covering the rearwardly extending portion of the frame; wherein the lengths of necessary ones of the elongate frame members are adapted to be used in selective lengths, to provide goal assemblies of various sizes and shapes, wherein each frame member which is selective in length comprises at least two elongate sections and means securing said sections removably together in selective overlapping relationship as required to provide a goal assembly of selected size and shape.

2. The ball goal assembly of claim 1, wherein each frame member which is selective in length comprises:

two tubular end sections each secured at an end to an associated frame member joining means;

a tubular center section telescopically associated with the end sections; and means removably securing the end sections to the center section selectively therealong as required to provide a goal assembly of selected size and shape.

3. The ball goal assembly of claim 2, wherein the frame member joining means comprises:

socket means adapted for removable frictional engagement of the associated ends of the frame members.

4. The ball goal assembly of claim 3, wherein the frame comprises:

a pair of spaced apart vertical front members;

a horizontal front top member spanning between the top ends of the vertical front members;

a pair of horizontal side members extending rearwardly from the bottom ends of the vertical front members;

a horizontal rear member parallel to the front top member and spanning between the rearmost ends of the side members; and a pair of inclined members each spanning from one of the ends of the front top members to a corresponding end of the horizontal rear member; wherein all frame members are of selective length.

5. The ball goal assembly of claim 4, further comprising:

said net means secured to the frame members to cover the rear and side portions of the frame, said net means being sized for use with the largest selective goal assembly size and secured slideably along the frame members, so that selective smaller goal assembly sizes are accommodated by accordioning the net means along the members.

6. The ball goal assembly of claim 5, wherein:

each of the four lowermost frame member joining means further comprises ground-contacting foot means supporting and anchoring the goal assembly upon the ground.

7. The ball goal assembly of claim 4, wherein the means securing the end and center sections of each of the selective length frame members comprises:

bores diametrically through the walls of the center section tube spaced at selective intervals therealong;

at least one bore diametrically through the wall of the tube of each end section; and bolt means installed through the end tube bores and selected matching center tube bores.

8. The ball goal assembly of claim 4, wherein the end to center section securing means comprises:

spring detent means.

9. The goal assembly of claim 2, wherein the end to center section securing means comprises:

bores diametrically through the walls of the center section tube spaced at selective intervals therealong;

at least one bore diametrically through the wall of the tube of each end section; and bolt means installed through the end tube bores and selected matching center tube bores.

10. The ball goal assembly of claim 2, wherein the end to center section securing means comprises:

spring detent means.

11. The ball goal assembly of claim 1, wherein the frame member joining means comprises:

means removably securing the associated ends of the frame members thereto.

12. A ball goal assembly comprising:

a frame comprising elongate members and adapted to rest generally upright upon the ground, the members defining an upright rectangular front opening and a rearwardly extending portion affixed thereto;

net means covering the rearwardly extending portion of the frame; wherein the lengths of necessary ones of the elongate frame members are adapted to be used in selective lengths, to provide goal assemblies of various sizes and shapes, wherein;

each frame member is secured removably to means joining it with other frame members, and the goal assembly further comprises;

at least two sets of the frame members each of fixed lengths, each one of said sets having members of required lengths for assembly of the goal of a selective size and shape, so that goals of at least two selected sizes and shapes may be assembled.

* * * * *